US006311342B1

(12) United States Patent
Hwang

(10) Patent No.: US 6,311,342 B1
(45) Date of Patent: Nov. 6, 2001

(54) FLUSH ACTIVATION SYSTEM

(76) Inventor: Tom Hwang, 300 Cherry St., Waverly, OH (US) 45690

( * ) Notice: Subject to any disclaimer, the term of this patent is extended or adjusted under 35 U.S.C. 154(b) by 0 days.

(21) Appl. No.: 09/608,015

(22) Filed: Jun. 30, 2000

(51) Int. Cl.[7] ..... E03D 1/14
(52) U.S. Cl. ..... 4/325; 4/394
(58) Field of Search ..... 4/324, 325, 379, 4/392, 393, 394

(56) References Cited

U.S. PATENT DOCUMENTS

| | | | | |
|---|---|---|---|---|
| 2,962,727 | * | 12/1960 | Kanter et al. | 4/394 X |
| 3,156,930 | * | 11/1964 | Moulton et al. | 4/325 |
| 3,199,118 | * | 8/1965 | Moschetta et al. | 4/325 |
| 5,459,885 | * | 10/1995 | Gaw | 4/325 |

* cited by examiner

*Primary Examiner*—Robert M. Fetsuga

(57) ABSTRACT

A flush activation system is provided for controlling the drainage of water from a toilet flush tank during a flush. The system comprises a valve assembly; a displaceable flush lever assembly coupled to the valve assembly; at least one auxiliary assembly coupled to the flush lever assembly; and, an actuation assembly coupled to the auxiliary assembly. The valve assembly includes a valve member displaceable for initiating and terminating the drainage of water from the flush tank. The flush lever assembly is adapted to actuate the displacement of the valve member. The auxiliary assembly includes an activating arm having at least one activating float component coupled at a terminal end thereof, and is pivotally displaceable between angularly offset active and inactive positions. The activating arm is biased in orientation at both its active and inactive positions in angularly disposed directions away from a vertical orientation. It operates in its active position to actuate at least a portion of the flush lever assembly to maintain the valve member in such position to permit the drainage of water at least until the water level within the flush tank drops beyond a predetermined activating water level.

22 Claims, 7 Drawing Sheets

FLUSH ACTIVATION SYSTEM

BACKGROUND OF THE INVENTION

1. Field of the Invention

The subject flush activation system is generally directed to a system for selectively actuating a toilet flush. More specifically, the subject flush activation system is directed to a system which simply, efficiently, and reliably enables the selective activation of various flush modes that respectively consume varying volumes of water.

Water conservation remains a point of universal concern around the World. So significant is the concern in certain regions that severe use restrictions and pervasive equipment/facilities regulations are not uncommon in many jurisdictions.

A source of substantial water consumption, at least in the more modernized regions of the world, remains water-flushed toilet facilities. Given their obvious necessity, curtailing usage does not, in most cases, constitute a viable option towards water conservation. Controlling the means of their usage, however, does constitute a viable and, indeed, advisable option. Accordingly, regulations such as that limiting the maximum volume of water stored within a flush tank at any given time have been widely instituted, especially in the United States.

Beyond such regulations, further controls may be implemented to minimize the volume of water consumed in a particular flush. Depending on the composition and quantity of waste to be removed from a toilet by a given flush, the volume of water required may be selectively varied. Rather than draining the full content of the toilet's flush tank indiscriminately with every flush; the flush tank's content may be partially drained where only liquid and/or small amounts of solid waste are to be removed, and more fully drained where greater amounts of solid waste are to be removed. The potential for conserving water by controlling the toilet flush operation in this manner is quite significant, given the far greater frequency with which flushes are typically activated to remove merely liquid waste than to remove both liquid and solid wastes.

In order to realize the enormous potential for water conservation thus available, a flush activation system that is reliable enough in operation yet simple (and inexpensive) enough for quick, convenient installation into existing toilet flush system designs is necessary. Given the inherent operation of commonly employed gravity flow toilets, and the restrictive mechanical (and aesthetic) confines within which their interacting components are disposed, though, attaining a suitable flush activation system remains no trivial matter. The need remains for a sufficiently simple and efficient, yet reliable and easily-installed flush activation system for selectively varying the volume of water drained from a given flush tank by a flush.

2. Prior Art

Mechanisms for variably controlling a toilet's flush are known in the art. The best prior art known to Applicant includes U.S. Pat. Nos. 5,459,885; 5,206,960; 5,903,391; 5,511,253; 5,450,634; 5,331,690; 5,303,728; 5,205,000; 4,864,665; 4,837,867; 4,080,668; 4,829,605; 4,145,774; 3,981,029; 3,945,056; 3,894,299; 3,839,746; 5,887,292; 5,881,399; 5,699,563; 5,673,440; 5,642,533; 5,555,573; 5,524,297; 5,465,432; 5,319,809; 5,301,373; 5,157,795; 5,005,225; 4,878,256; 4,937,894; 4,651,359; 4,561,131; 4,433,445; 4,172,299; 4,149,283; 4,135,263; 4,096,591; 3,906,554; 3,903,550; 3,877,082; 3,858,250; and, 5,067, 180. Such known mechanisms, however, fail to provide the sufficient combination of simplicity, efficiency, reliability and ease of installation for optimum practicability.

U.S. Pat. No. 5,459,885, for instance, discloses a dual flush mechanism for a toilet which enables both full and partial flush actuation. The mechanism employs a flush activation arm coupled by a transverse shaft to a handle. The free end of this flush activation arm is connected to a flush float which, in turn, is connected to a non-buoyant flush valve. A partial flush is effected by pivotally displacing the handle which, in turn, pivotally displaces the flush activation arm such that its free end lifts open the flush valve. The buoyancy of the flush float 26 then maintains the flush valve in this open position until the water level drops below it. At that point, the flush float falls by the force of gravity to permit the closure of the flush valve.

A full flush is effected through additional components which, when activated, blocks the flush activation arm from returning to its rest, or original, orientation. The additional components include a contoured contact plate (70) coupled to a pivot assembly (64) from which a rod (62) formed with a second flush float extends. This contact plate (70) bears against the terminal end of a control bar (40) which extends radially from the shaft connecting the handle (36) and flush activation arm (28).

When the control bar (40) is displaced during a partial flush responsive simply to a pivotal displacement of the handle (36), its tip remains thus engaged with the contact plate (70). When the control bar (40) is displaced during a full flush responsive to both an axial and a pivotal displacement of the handle (36), though, its tip proceeds to disengage from the contact plate (70), freeing that contact plate (70) for displacement beyond that tip. At that point, the rod (62) and the second flush float (60) which had been retained in the vertical orientation are freed to swing together upward, causing a laterally extended portion of the contact plate (70) to bear against and support a bottom edge of the control bar (40). This then maintains the shaft (38) and the flush activation arm (28) from returning to their non-activated orientations until the water level within the tank (12) drops sufficiently below the second flush float (60). It is only after the water level falls to a sufficiently low level that the rod (62) and second flush float (60) return to their vertical, or rest, position—to concurrently permit the contact plate's return to its original position.

A number of significant drawbacks are readily apparent in this mechanism. Perhaps the most significant is the fact that the mechanism demands a high degree of precision in its implementation. For example, the rod (62) must return fully to its vertical position before the contact plate (70) may disengage the bottom edge of the control bar (40), then re-engage the tip thereof. That is, the partial flush actuation function cannot be used again until and unless the rod (62) is permitted to return to its fully vertical position. This affords very little tolerance in such things as the length of the chains linking the flush valve (16) and the flush activation arm (28) (via the float 26). If even a slight bit of slack is present in these chains, for example, the slack may be sufficient to permit the flush valve's premature closure (before the water level has dropped enough for the second flush float (60) to descend to the point where it places the rod (62) in its fully vertical orientation). With the flush valve (16) closed, water would again begin filling the tank (12), again urging the second flush float (60) and rod (62) away from that fully vertical position, back to its activating position. Hence, the partial flush actuation function cannot be used again after the initial occurrence of a full flush without manual intervention by a user, and all subsequent flushes remain exclusively full flushes.

Another drawback is found in the frictional engagement of the control bar (40) against the contact plate (70). The cumulative effects of such frictional engagement repetitively occurring over an extended period of use would eventually lead to pronounced erosion in the engaging surfaces. Consequently, both the smooth operation and the structural integrity would be severely compromised.

Yet another drawback may be found in the relative complexity of the required motion for actuating a full flush. The concurrent pushing and turning of the handle 36 that is necessary may prohibitively difficult to some users.

SUMMARY OF THE INVENTION

It is therefore a primary object of the present invention to provide a flush activation system incorporating a mechanism operable during one or more flush modes to reciprocally displace in stable manner between active and inactive positions for respectively effecting the opening and closing of a given flush tank's flush mode.

It is another object of the present invention to provide a flush activation system actuable in a first mode to effect a flush that consumes a first volume of water stored in a given flush tank, and actuable in at least one additional mode to effect a flush that consumes a second volume of water.

It is another object of the present invention to provide a flush activation system that is simple in configuration yet operates efficiently and reliably.

It is yet another object of the present invention to provide a flush activation system tolerant in operation to a substantial degree of imprecision in the implementation of various components.

These and other objects are attained by a flush activation system formed in accordance with the present invention. The subject flush activation system is operable to control the drainage of water from a toilet flush tank during a flush. The system preferably comprises, generally: a partial flush mechanism independently actuable to initiate and terminate the drainage from the flush tank of a first volume of water; a full flush mechanism actuable to initiate and terminate the drainage from the flush tank of a second volume of water greater than the first volume of water; and, an actuation assembly coupled to the partial and full flush mechanisms for the selective actuation thereof. The partial flush mechanism operates to maintain the drainage of water at least until the water level within the flush tank drops beyond a first predetermined water level during a flush.

The full flush mechanism includes a lever arm pivotally displaceable between opening and closing positions for respectively opening and closing a drain seal of the flush tank. It further includes an activation arm coupled to the lever arm pivotally displaceable between angularly offset active and inactive positions. In the active position, this activation arm maintains the lever arm in the opening position thereof during the drainage of water at least until the water level within the flush tank drops beyond a second predetermined water level defined below the first predetermined water level. The activation arm is preferably biased to displace to its inactive position responsive to the water level dropping below the second predetermined water level. The full flush mechanism further includes at least one float component coupled adjacent a terminal end portion of the activation arm which serves to buoyantly bias the activation arm in orientation at its active and inactive positions in angularly opposed directions away from a vertical orientation.

DETAILED DESCRIPTION OF THE PREFERRED EMBODIMENTS

Figure 1:
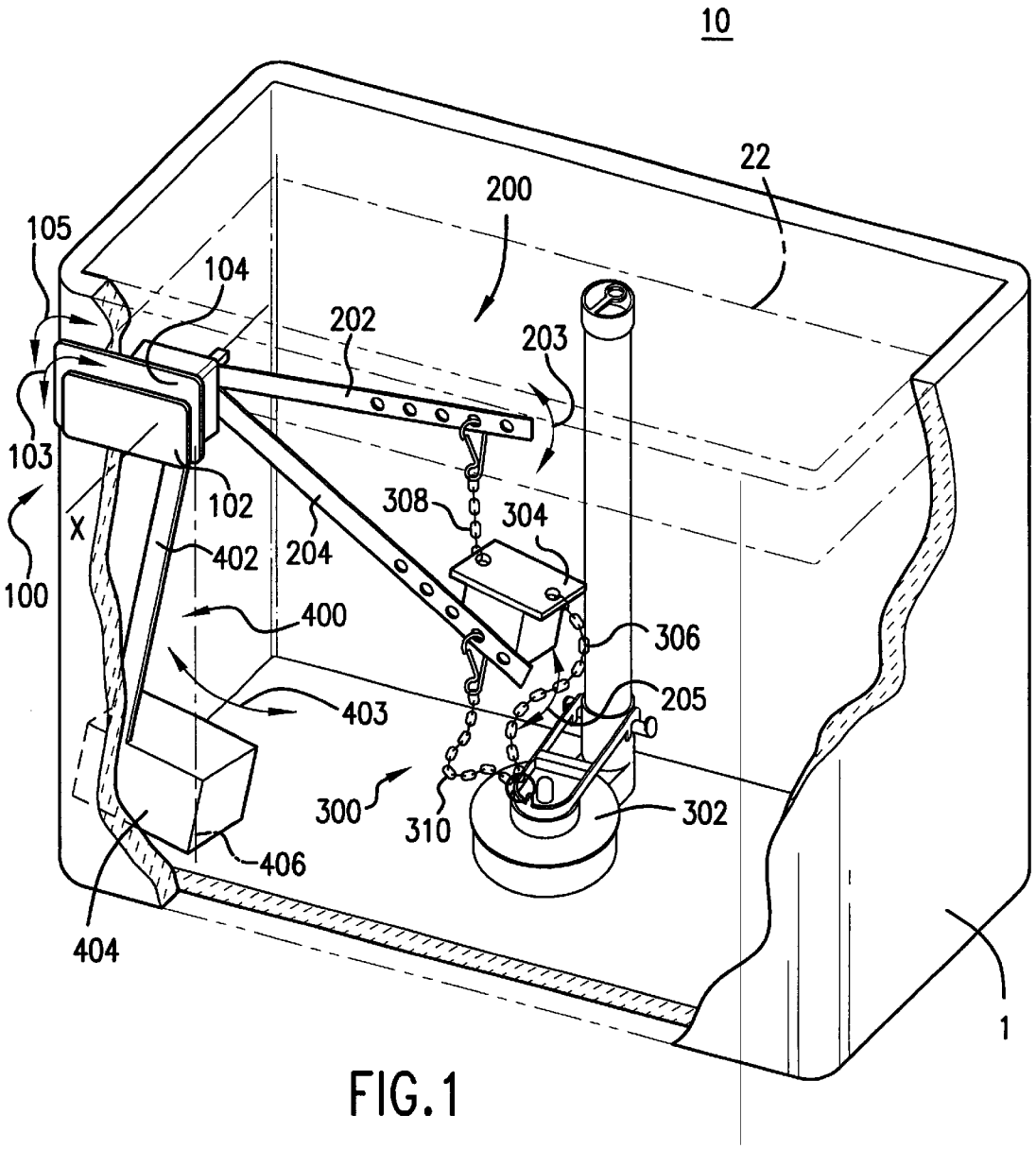
FIG. 1 is a perspective view, partially cut-away, of one embodiment of the flush activation system of the present invention shown installed in a toilet flush tank.

Turning now to FIG. 1, there is shown one embodiment of the subject flush activation system 10 installed on a flush tank 1. System 10 generally includes an actuation assembly 100 for selectively actuating partial or full flush mechanisms which initiate and terminate the drainage from flush tank 1 through a drain of different volumes of water collected therein. Generally, the flush operation in a typical gravity flow toilet is initiated by unsealing a normally sealed drain 2 (FIGS. 4 and 5) of flush tank 1. The water within tank 1 then begins to drain out into the accompanying toilet bowl (not shown). Once the water level within tank 1 drops to a sufficiently low level, drain 2 is again sealed to permit the tank's re-filling by a valve-controlled water inlet mechanism (not shown) of any suitable type known in the art.

The partial and full flush mechanisms are implemented in the embodiment shown to include a flush lever assembly 200 displaceable in accordance with a user's corresponding manipulation of actuation assembly 100. Flush lever assembly 200 operates responsively upon a partial flush valve assembly 300, so as to either force open or allow the sealed closure of drain 2. The full flush mechanism is implemented by further incorporating an auxiliary assembly 400 coupled to at least a portion of flush lever assembly 200 for appropriately controlling the displacement of that flush lever assembly portion when a full flush mode of operation is activated.

Actuation assembly 100 may be of any suitable type known in the art. While structural particularities of the assembly are not important to the present invention, it is preferably adapted to effect at least two different modes of operation responsive to correspondingly distinct manipulations thereof by a user.

Figure 3:
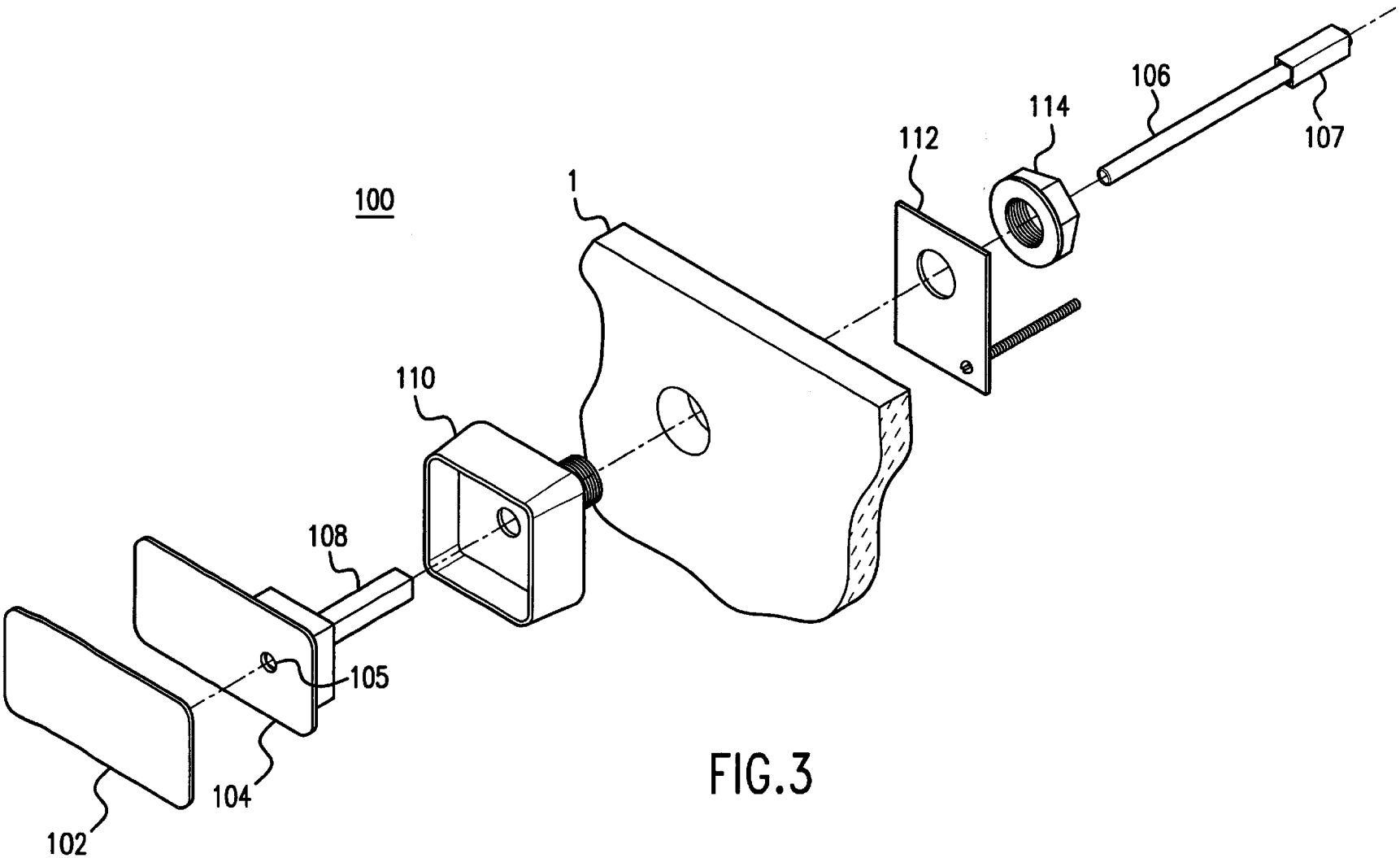
FIG. 3 is an exploded perspective view of a portion of the embodiment shown in FIG. 1.

In the embodiment shown, actuation assembly 100, as detailed in the exploded view of FIG. 3, includes first and second handle members 102, 104 coaxially disposed in independently displaceable manner to a pivot shaft 106. The pivotal displacement of first handle member 102 indicated by the bi-directional arrow 103 causes a corresponding rotation of pivot shaft 106 about an axis X. The pivotal displacement of second handle member 104 indicated by the bi-directional arrow 105 causes a corresponding displacement of a polygonal extension 108 thereof about pivot shaft 106 (and about the axis X).

As shown, first and second handle members 102, 104 are joined through the wall of flush tank 1 with pivot shaft 6 via a positioning bracket 110, a washer plate 112, a fastener 114, and any other suitable hardware mechanism. Pivot shaft 106 passes through respective openings of the intervening hardware to protrude outward from flush tank 1. The protruding terminal portion of pivot shaft 106 is then received coaxially through the polygonal extension 108 and a through hole 105 of second handle member 104 before first handle member 102 is securely coupled thereto. Polygonal extension 108 is formed with sufficient length to extend axially through the openings of the intervening hardware (and wall of flush tank 1) to protrude inward from the inner wall surface of flush tank 1. With an appropriately shaped opening formed therein, the auxiliary lever arm 204 (described in following paragraphs) may be securely received upon that protruding portion of polygonal extension 108.

Pivot shaft 106 includes a polygonal section 107 positioned thereon as shown to remain axially offset from polygonal extension 108 of second handle 104 upon the full assembly of the components shown. Polygonal portion 107 is contoured to securely engage a correspondingly shaped opening formed in a primary lever arm 202 (described in following paragraphs). Polygonal portion 107 is fixedly disposed with the other portions of pivot shaft 106, such that it displaces angularly about the axis X responsive to the pivotal displacement of first handle member 102, and thereby serves as a mechanical link for transferring the pivotal displacement of first handle member 102 to primary lever arm 202.

Flush lever assembly 200 in this embodiment includes a primary lever arm 202 and an auxiliary lever arm 204. As described in preceding paragraphs, primary lever arm 202 is rigidly coupled at polygonal portion 107 of pivot shaft 106 such that it pivotally displaces with that pivot shaft's rotation about the axis X, as indicated by the bi-directional arrow 203. Auxiliary lever arm 204 is rigidly coupled to extension portion 108 such that it displaces pivotally with that extension's rotation about the axis X, as indicated by the bi-directional arrow 205.

Figure 3A:
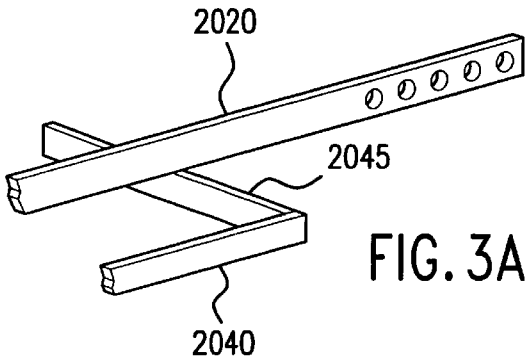
FIG. 3A is a perspective view, partially cut-away, of an alternate embodiment of a portion of the flush activation system of the present invention.

In the embodiment shown, primary lever arm 202 and auxiliary lever arm 204 are separately and independently displaceable responsive to displacements, respectively, of handle members 102, 104. In alternate embodiments, however, appropriate coupling measures may be incorporated to permit the use of a common flush lever arm in effecting each distinct flush mode activated. In the alternate embodiment shown in FIG. 3A, for instance, primary lever arm 2020 remains commonly displaceable responsive to separate and distinct manipulations of actuation assembly 100. Auxiliary flush lever arm 204 in that embodiment is replaced by a pivotally displaceable auxiliary member 2040 from which a transverse member 2045 extends to pass beneath primary lever arm 2020 as shown. When auxiliary member 2040 pivotally displaces upward, transverse member 2045 forces a concurrent pivotal displacement upward of primary lever arm 2020. So long as auxiliary member 2040 remains displaced upwardly, therefore, primary lever arm 2020 remains correspondingly displaced upward.

Figure 3B:
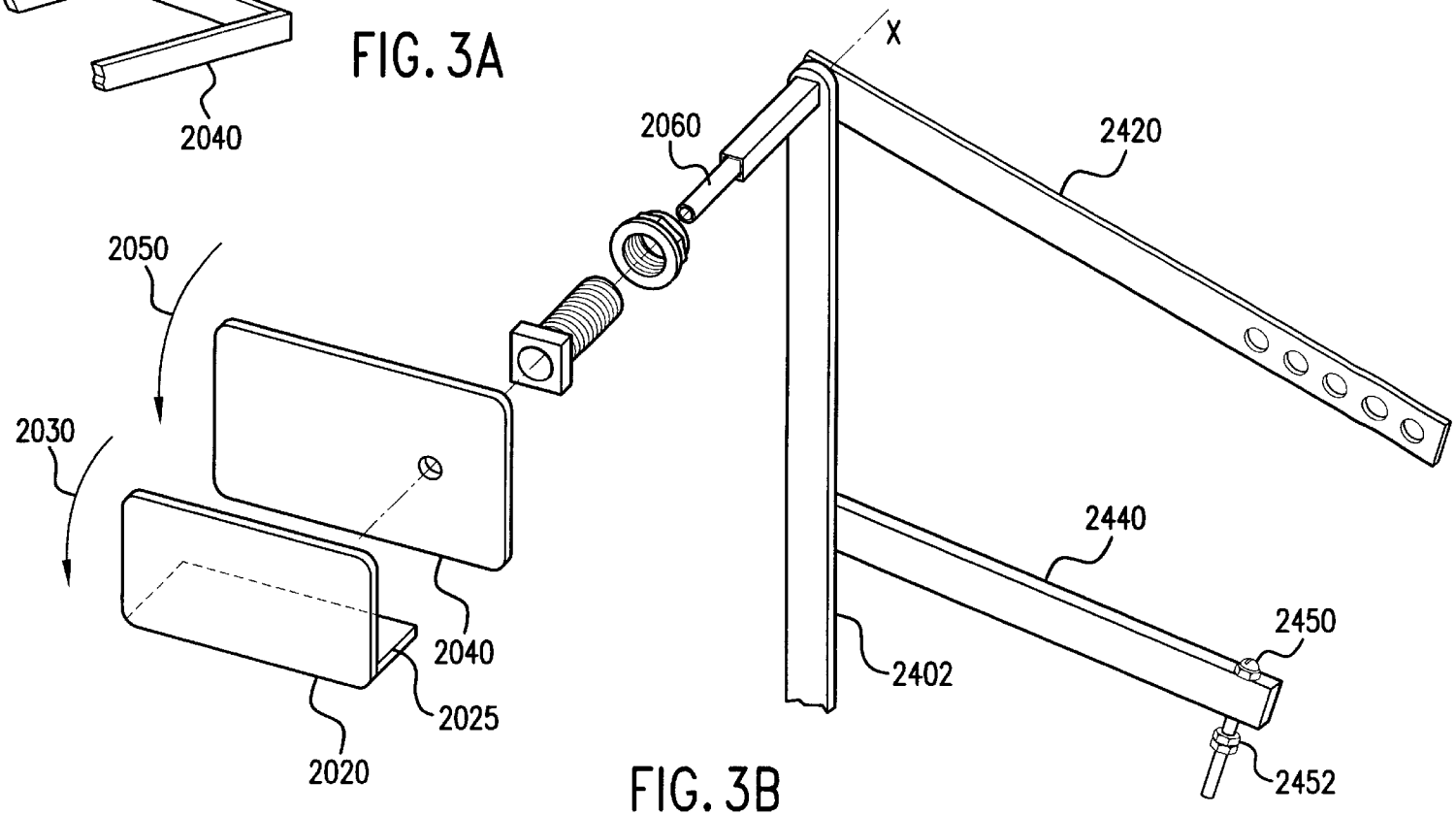
FIG. 3B is a perspective view, partially cut-away, of another embodiment of a portion of the flush activation system of the present invention.

Other suitable alternate embodiments of the actuation and flush lever assemblies 100, 200 may also be employed. One such alternate embodiment is illustrated in FIG. 3B. In that embodiment, a primary lever arm 2420 is again commonly employed in effecting each distinct flush mode that is to be activated. Primary lever arm 2420 is linked to a first handle member 2020 by a pivot shaft 2060 such that it displaces pivotally about the axis thereof responsive to the pivotal displacement of first handle member 2020 in the direction indicated by the arrow 2030. This would activate a first flush mode.

Pivot shaft 2060 in this embodiment passes through an opening formed in activating arm 2402 which, as in the other embodiments already described, includes an activating float component 404 (not shown) coupled at the bottom end thereof. Pivot shaft 2060 also passes through an opening formed in a second handle member 2040 which is rigidly coupled to activating arm 2402. Thus, when pivot shaft 2060 is rotated about its axis X with the pivotal displacement of first handle member 2020 (and primary lever arm 2420), it causes neither activating arm 2402 nor second handle member 2040 to displace. A second flush mode may nonetheless be activated by pivotally displacing second handle member 2040 in the direction indicated by the arrow 2050. Such downward displacement of second handle member 2040 causes it to engage a catch flange portion 2025 extending laterally from first handle member 2020, so as to cause that catch flange portion 2025 and first handle member 2020 to also displace pivotally downward. Accordingly, primary lever arm 2420 is caused to pivotally displace concurrently with activating arm 2402.

An auxiliary arm 2440 is formed to extend laterally from activating arm 2402. Auxiliary arm 2440 serves in this embodiment primarily weighting and counterbalancing purposes, so that the proper operation of activating arm 2402 (and activating float component 404 attached thereto) occurs properly as described in following paragraphs with reference to other disclosed embodiments. A weighting mechanism 2450 preferably having a securement fastener 2452 may be provided on auxiliary arm 2440 to provide the arm with weighting adjustability.

Returning to FIG. 1, partial flush valve assembly 300 may, too, be realized through numerous other embodiments, so long as it operates suitably to effect the re-closure/seal of the drain 2 responsive automatically to the water level within the tank 1 dropping below a predetermined intermediate water level. In the embodiment shown, partial flush valve assembly 300 includes a valve member 302 displaceable between open and closed positions over drain 2 for alternatively opening and sealing it for and against the drainage of water therethrough. Valve member 302 is formed in this embodiment with a non-buoyant structure such that it tends toward its closed position absent some restraining measure to prevent such closure.

Partial flush assembly 300 also includes in this embodiment a buoyant float component 304 connected to valve member 302 by a chain or other suitable link member 306, and to primary flush lever arm 202 by a chain or other suitable link member 308. Float component 304, which may be formed with any suitable configuration and composition known in the art, provides a buoyancy great enough to prevent the closure of valve member 302 once drainage of water from tank 1 has been initiated, but low enough to avoid disturbing valve member 302 from its closed position.

Figure 4:
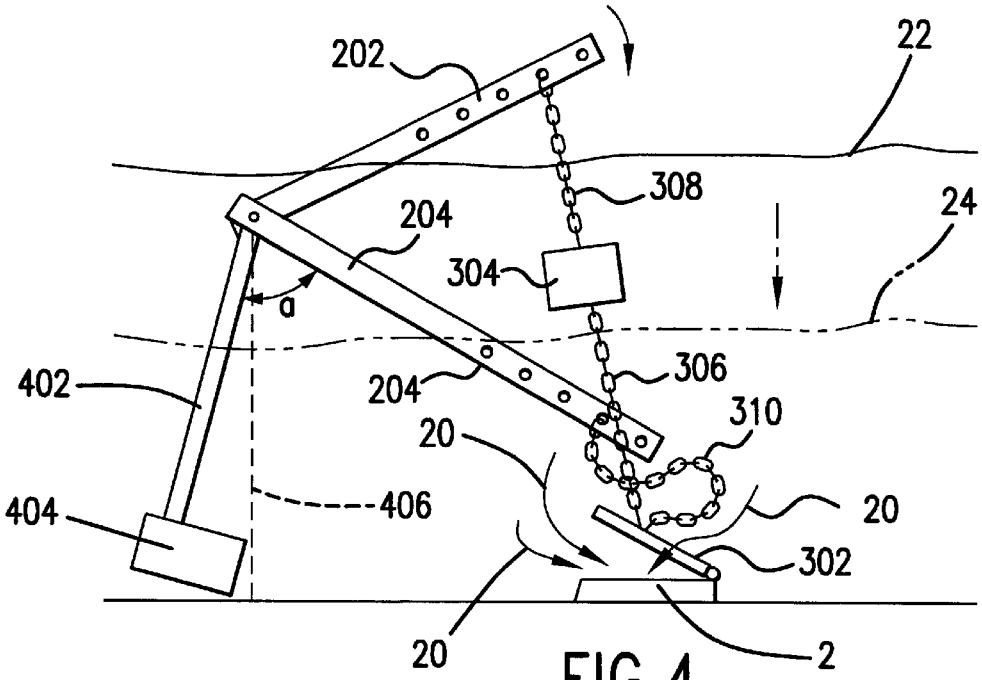
FIG. 4 is an illustrative view showing the relative positions of various components during a first mode of operation of the flush activation system of the present invention.
Figure 5:
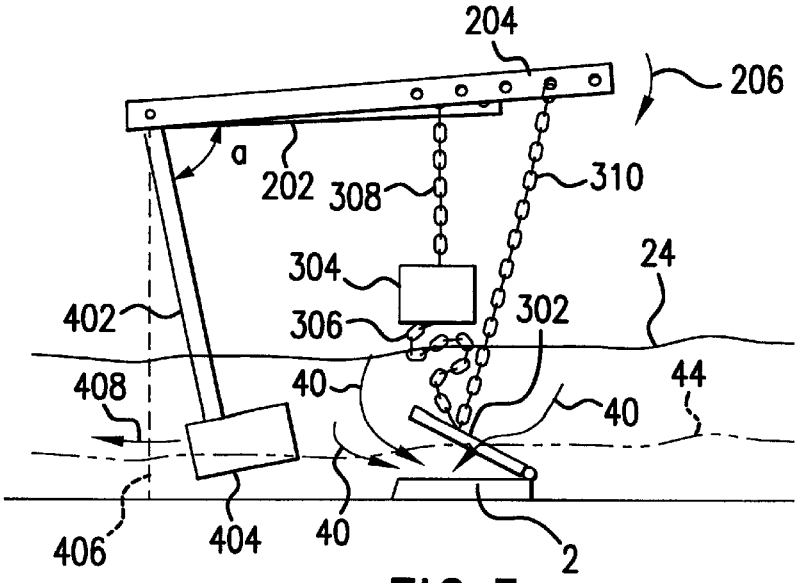
FIG. 5 is an illustrative view showing the relative positions of various components during a second mode of operation of the flush activation system of the present invention.

As illustrated in FIG. 4, when a partial flush mode is activated by accordingly displacing first handle member 102, the resulting pivotal displacement of primary lever arm 202 in the upward direction 203 draws valve member 302 upward to its open position (via link member 308, float component 304, and link member 306). Immediately, drainage of the water contained in flush tank 1 commences through drain 2, as indicated by the directional arrows 20. Even if handle member 102 is released by the user (to allow the return of primary lever arm 202 to its original position), the buoyancy of the water-submerged float component 304 retains valve member 302 in its open position as long as the water in flush tank 1 remains at a water level 22 above a first predetermined water level 24. When the water level drops beyond that first predetermined water level 24, float component 304 no longer remains submerged; hence, it falls by the force of gravity with the water level. This then permits valve member 302 to fall and close under the weight of the water upon it.

Turning back to FIG. 1, the full flush mechanism of system 10 incorporates an auxiliary assembly 400 shown in the given embodiment to include an activating arm 402 preferably extending downward from a proximal end portion of auxiliary lever arm 204. Auxiliary assembly 400 further includes an activating float component 404 coupled at a suitable point adjacent a terminal end portion of activating arm 402. Activating arm 402 and activating float component 404 are together pivotally displaceable with auxiliary lever arm 204, as indicated by the bi-directional arrow 403, between an inactive position and an active position (shown in FIG. 5). Much like float component 304, activating float component 404 may be formed 200 with any suitable configuration and composition known in the art to yield a buoyancy sufficient for the requirements of the given application.

When a second flush mode is activated by the user's appropriate manipulation of second handle member 104, auxiliary flush lever arm 204 and activating arm 402 are pivotally displaced, preferably as a unit, such that auxiliary lever arm 204 draws valve member 302, via link member 310, upward to its open position. Numerous other structural configurations of activating arm 402, auxiliary flush lever arm 204, and/or measures for their coupling are readily conceivable.

The open position of valve member 302 permits water to drain, as indicated by the directional arrows 40; and, the water level within tank 1 begins immediately to drop. Meanwhile, activating float component 404—which, in its inactive position (prior to the given flush activation), had been located on one side of a vertical orientation reference 406 to buoyantly bias activating arm 402 in angular orientation away therefrom (in the clockwise direction in the view as shown)—is now located in the active position, as shown, on an opposing side of the vertical orientation reference 406. Activating float component 404, there, also buoyantly biases activating arm 402 angularly away from the vertical orientation reference 406, but in an angular direction opposite that at its inactive position (or in the counter-clockwise direction in the view as shown).

As the water level in tank 1 drops with the drainage of water therefrom, the buoyant bias of activating float 404 retains auxiliary lever arm 204 in its upwardly displaced position to, in turn, maintain valve member 302 in its opened position. This condition remains so long as activating float component 404 remains substantially submerged. As the water level in flush tank 1 drops beyond the first predetermined water level 24, first float component 304 weighs downward via link member 308 upon primary lever arm 202. This, however, remains ineffectual to the disposition of auxiliary lever arm 204.

As the water level drop continues beyond a second predetermined water level 44, activating float component 404 is eventually left no longer submerged. Consequently, activating float component 404 and activating arm 402 are permitted to swing by force of gravity much like a pendulum to and angularly beyond the vertical orientation reference 406, as indicated by the directional arrow 408. The concurrent displacement of auxiliary lever arm 204 pivotally downward with activating arm 402, as indicated by the directional arrow 206, sufficiently releases valve member 302 for closure. As the water thereafter fills tank 1 and the water level again begins to rise, activating float component 404 gradually becomes submerged once again to buoyantly urge activating arm 402 angularly away from the vertical orientation reference 406 (in the clockwise direction). Thus, activating float component 404 again biases activating arm 402 to remain in its inactive position.

Note that in the embodiment shown, activating arm 402 is rigidly connected to auxiliary lever arm 204 to be angularly offset therefrom by a predetermined angle a. The resulting configuration aids in biasing the structure to return pivotally to its inactive position (whereby activating float component 404 and activating arm 402 are disposed as shown in FIG. 4). The actual value of the offset angle a may be set in accordance with the particular requirements of the given application. Depending on the requirements, for instance, the angle may be acute as shown or may even be obtuse (not shown).

It is important that the buoyancy of activating float component 404 be sufficient to bias activating arm 402 in angular orientation away from the vertical orientation reference 406 at both its inactive and active positions (on opposing sides of that reference 406), regardless of the mechanical characteristics of the specific components employed. It is also important, however, that the structure to which activating arm 402 and floating component 404 belong be balanced in such manner that activating float 404 tends by the force of gravity thereupon to swing towards its inactive position when it is disposed at or near the vertical orientation reference 406.

It is noted in this regard that additional measures to enable adjustment of the prevailing structure's balancing may be employed. An example of such adjustment measures are shown in the alternate embodiment of FIG. 2. As shown in that embodiment, auxiliary lever arm 1204 is formed with a plurality of longitudinally offset coupling holes 1206 formed along a portion of its length. A weighting mechanism 1500 is releasably coupled to one or more of the coupling holes 1206 to appropriately adjust the tendency of auxiliary lever arm 1204 to displace pivotally downward, as indicated by the directional arrow 1205.

Figure 2:
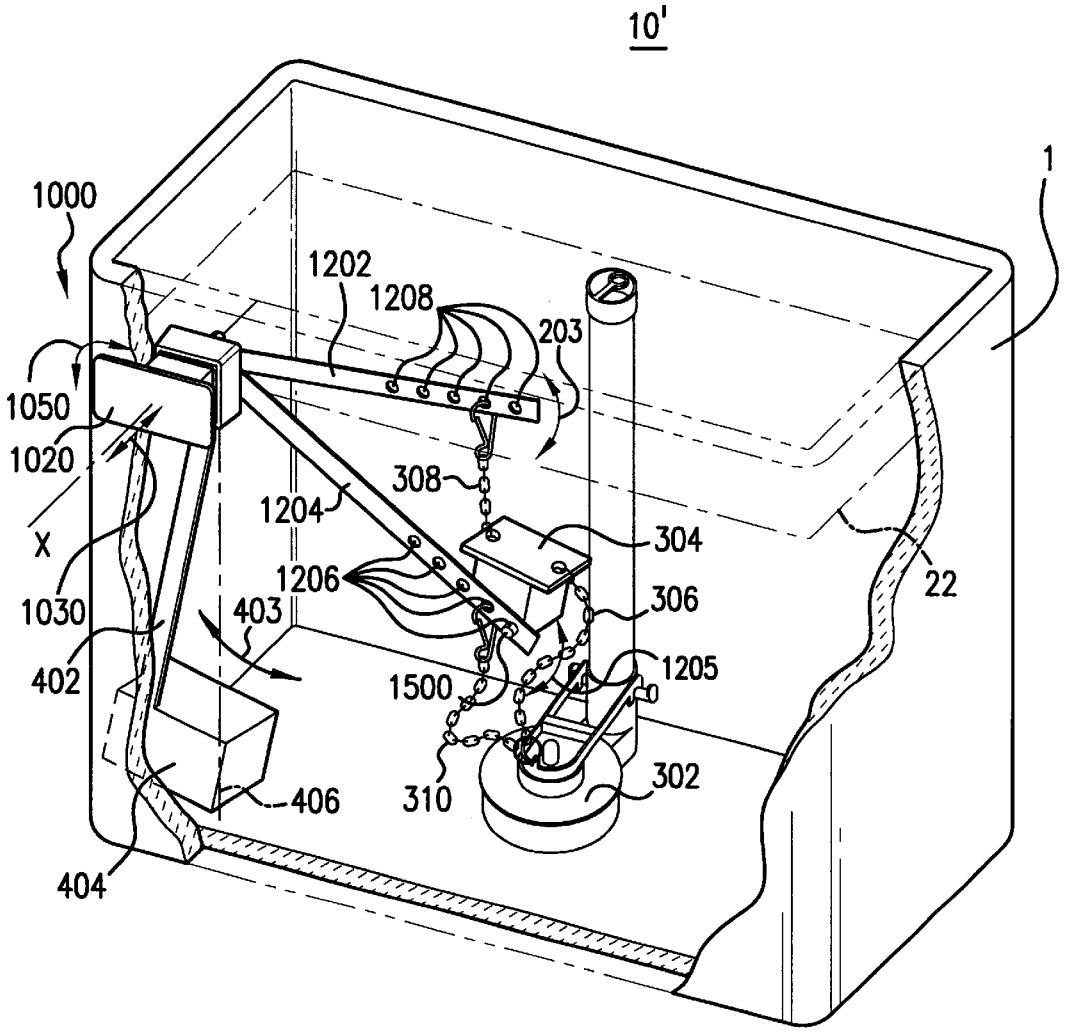
FIG. 2 is a perspective view, partially cut-away, of another embodiment of the flush activation system of the present invention shown installed in a toilet flush tank.

Also in the alternate embodiment of FIG. 2, a plurality of longitudinally offset coupling holes 1208 may be formed in primary lever arm 1202 along a portion of its length. By the selective coupling of link member 308 to one of these coupling holes 1208, adjustments may be made to adapt to the peculiar configurations of the given tank 1 and the components arranged therein.

The alternate embodiment of FIG. 2 employs an actuation assembly 1000 wherein a single handle member 1020 is commonly employed to activate each of the system's plurality of flush modes. For instance, handle member 1020 may be linearly displaced by pressing it towards flush tank 1, as indicated by the bi-directional arrow 1030, along the axis X. The mechanical coupling components detailed in the exploded view of FIG. 3A then cause responsive to such linear displacement of handle member 1020 the upward pivotal displacement of primary lever arm 1202 (independent of auxiliary lever arm 1204) along the path indicated by the bi-directional arrow 203. Operation of the system in the ensuing flush mode occurs substantially as described in preceding paragraphs with reference to the embodiment of FIG. 1.

Handle member 1020 may also be pivotally displaced about the axis X, as indicated by the bi-directional arrow 1050 to activate a second flush mode. The mechanical coupling of handle member 1020 to auxiliary lever arm 1204 is such that the auxiliary lever arm 1024 is responsively displaced pivotally upward along the path indicated by the bi-directional arrow 1205. Again, the system's operation in the ensuing flush mode occurs as described in preceding paragraphs with reference to the embodiment of FIG. 1.

In each of the embodiments disclosed in FIGS. 1 and 2, auxiliary assembly 400 and auxiliary lever arm 204 which cooperatively implement the full flush mechanism is employed in conjunction with a partial flush mechanism. In certain embodiments, however, auxiliary assembly 400 and auxiliary lever arm 204 may be employed without the presence of a partial flush or any other supplemental flush mechanism. The presence of such supplemental flush mechanism is not necessary for the advantageous flush activation control cooperatively enabled as described in preceding paragraphs by auxiliary assembly 400 and auxiliary lever arm 204.

Figure 6:
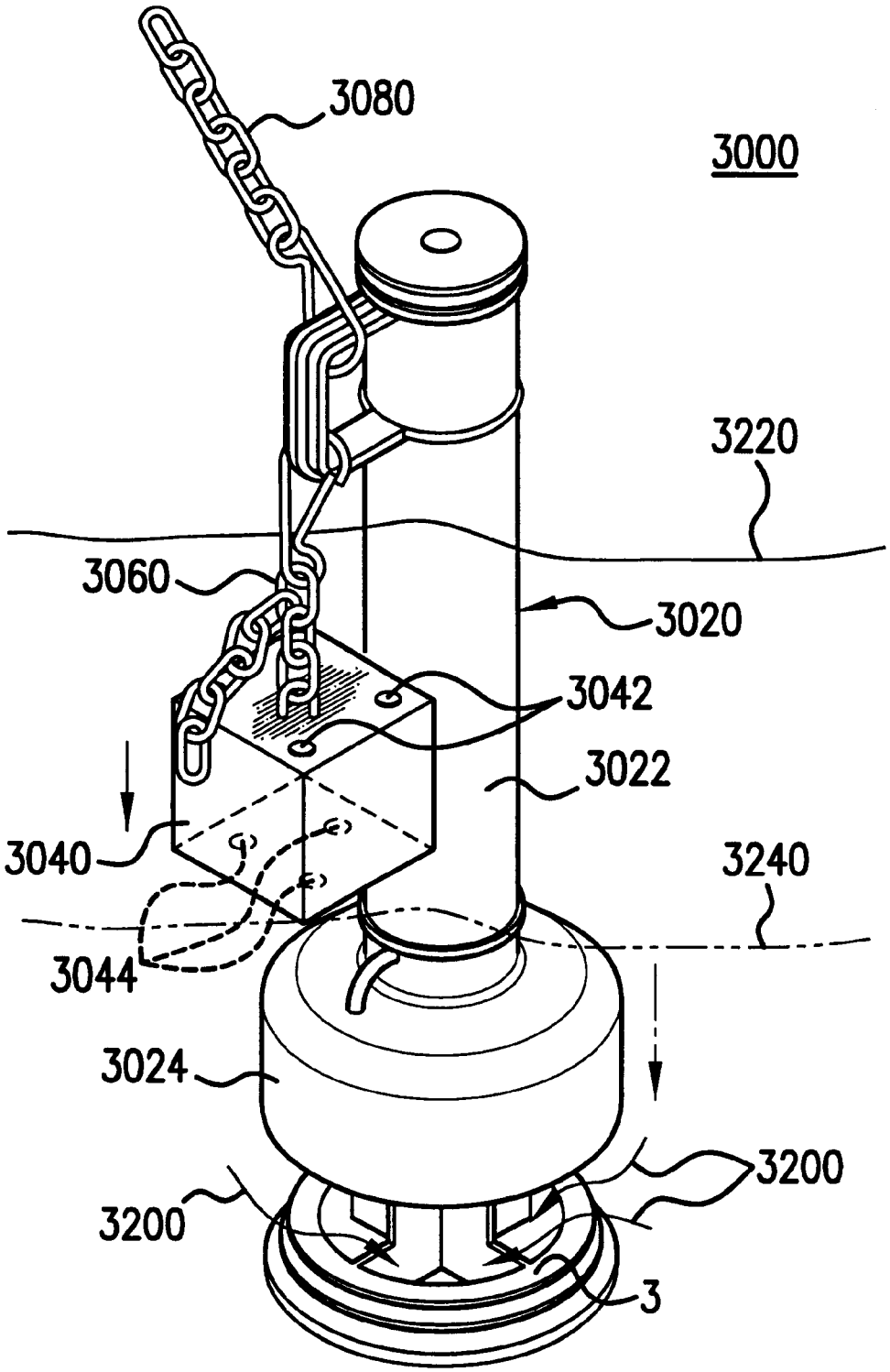
FIG. 6 is a perspective view of an alternate embodiment of a flush valve assembly that may be employed in the flush activation system of the present invention; and, FIG. 7 is a perspective view of another alternate embodiment of a flush valve assembly that may be employed in the flush activation system of the present invention.

Referring now to FIG. 6, there is shown an alternate embodiment 3000 of the partial flush valve assembly. As shown, assembly 3000 in this embodiment includes a Mansfield-type valve known in the art having an elongate tubular portion 3022 coaxially coupled in displaceable manner to a post for axial displacement thereon. Valve member 3020 further includes a bottom float portion 3024 having a buoyancy which enables it to remain buoyantly suspended when it is drawn upward to keep open a drain 3 below it. When thus drawn to its open position, valve member 3020 permits water to drain from the tank, as indicated by the directional arrows 3200.

Normally, due to the buoyancy of its float portion 3024, valve member 3020 remains suspended in its open position until the water level drops beneath that float portion 3024, whereupon it descends by force of gravity to cover and seal the drain 3. In the embodiment shown, however, assembly 3000 is also equipped with a weighting component 3040 coupled to valve member 3020 via a chain or other comparable link member 3060. When the water level has dropped to a predefined point relative thereto, weighting component 3040 serves to counteract the buoyancy of the valve member's float portion 3024 and thereby urge the premature descent of valve member 3020 to its closed position before the water level actually drops beneath that float portion 3024.

Weighting component 3040 is preferably formed with a body defining a substantially hollow inner compartment. The body is formed with an upper perforated portion 3042 to permit the entry of water into the inner compartment for weighting purposes. Supplementary measures for stabilizing the position and orientation of weighting component 3040 may be employed, such as inserting one or more weighting ballasts (not shown) within the inner compartment and/or forming the body from a dense material. Preferably, the body of weighting component 3040 is also formed with a bottom perforated portion 3044 for the release of water from the inner compartment in a sufficiently gradual manner as to—without prematurely halting the descending closure of valve member 3020—effectively minimize the weight to be counteracted by auxiliary assembly 400 during a full flush mode of system operation.

In operation, valve member 3020 is drawn upwards by flush lever arm assembly 200, via a chain or comparable link member 3080. This occurs regardless of the mode of flush activated. Where a full flush mode has been activated, valve member 3020 will remain in its open position until the water level is permitted to descend by the operation of auxiliary assembly 400. Where a partial flush mode has been activated, however, valve member 3020 remains in its buoyantly suspended open position only until the water, level initially at 3220, drops beyond a predetermined intermediate water level 3240. At that point, weighting component 3040 which had theretofore been substantially submerged in water is no longer submerged and weighs downward upon valve member 3020 sufficiently to overcome the buoyancy of float portion 3024. Accordingly, valve member 3020 is caused to descend prematurely to its closed position upon drain 3.

Figure 7:
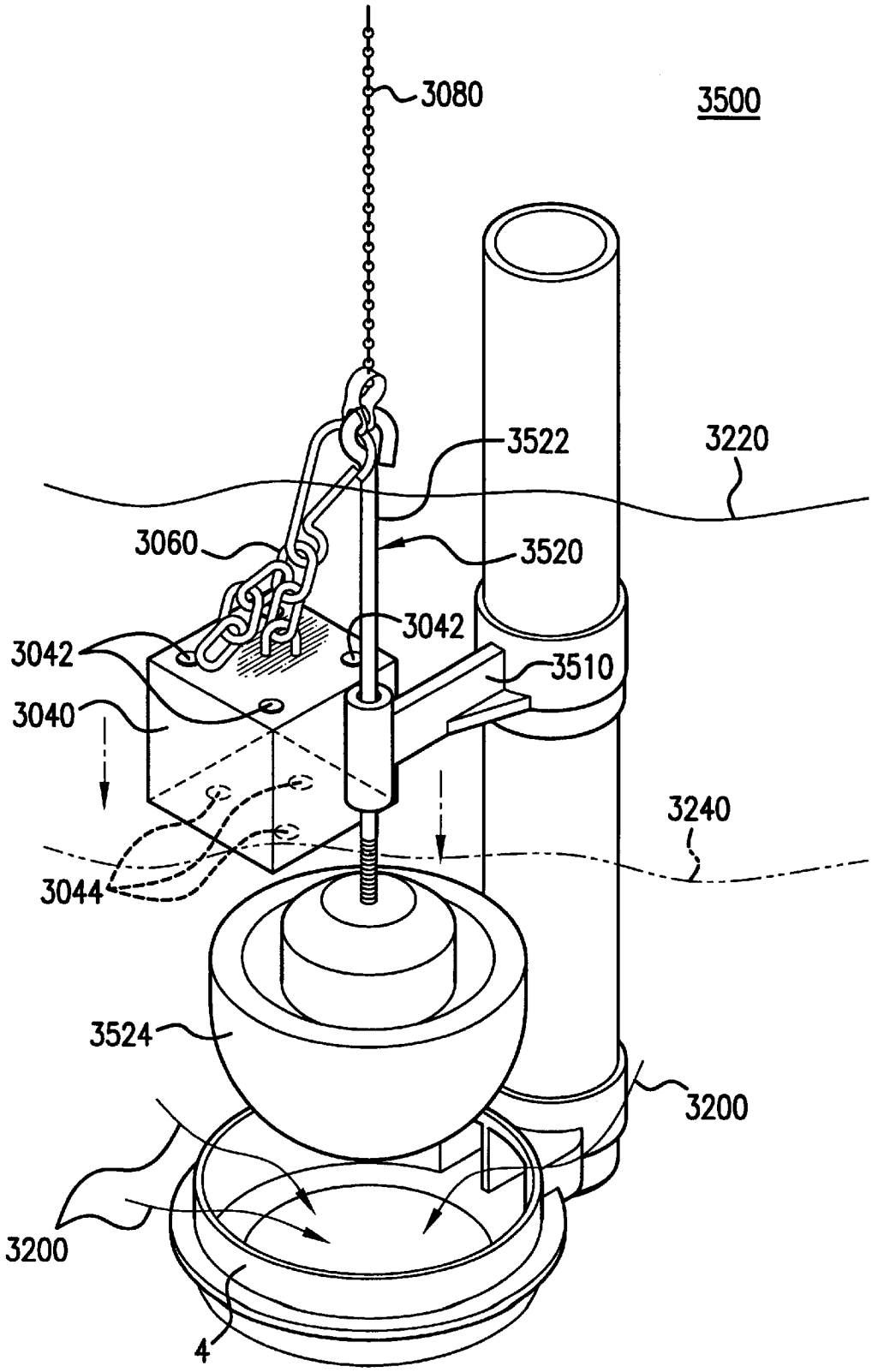

Turning now to FIG. 7, there is shown another alternate embodiment 3500 of the partial flush valve assembly. The operation of this embodiment is similar to that of assembly 3000 shown in FIG. 6. Valve member 3520 in this embodiment is also of a type known in the art, but is formed with a shaft portion 3522 supported by a support structure 3510 to be axially displaceable between open and closed positions over a tank drain 4. At the bottom end of shaft portion 3522 is formed a buoyant float portion 3524 which, much like float portion 3024 of valve member 3020 in FIG. 6, normally maintains valve member 3520, upon the activation of a flush, buoyantly suspended in its open position above drain 4 until the water level drops beneath it. Weighting component 3040 is coupled to shaft portion 3522 by link member 3060, as before, to urge the descent of 20O valve member 3520 to its closed position once the water level drops to the predetermined intermediate water level 3240 during a partial flush mode of operation. Float component 3040 and its contents weigh valve member 3520 sufficiently downward to overcome the buoyancy of float portion 3524. Of course, once valve member 3520 is fully seated upon drain 4, the weight of the water upon it prevents its upward displacement.

Note that alternate embodiments such as those shown in FIGS. 6 and 7 for the partial flush valve assembly may be independently employed apart from the other features disclosed for system 10 to simply adjust the volume of water released by a flush in a given flush activation system.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular combinations of system components may be interchanged or interposed, all without departing from the spirit or scope of the invention as defined in the appended Claims.

What is claimed is:

1. A flush activation system for controlling the drainage of water from a toilet flush tank during a flush comprising:

(a) a valve assembly including a valve member displaceable between open and closed positions for respectively initiating and terminating the drainage of water from the flush tank;

(b) a displaceable flush lever assembly coupled to said valve assembly for actuating the displacement of said valve member from said closed position to said open position;

(c) at least one auxiliary assembly coupled to said flush lever assembly, said auxiliary assembly including an activating arm having at least one activating float component coupled adjacent a terminal end thereof, said activating arm being pivotally displaceable between angularly offset active and inactive positions, said activating arm being biased in orientation at said active and inactive positions in angularly opposed directions away from a vertical orientation, said activating arm in said active position actuating at least a portion of said flush lever assembly to maintain said valve member in said open position during the drainage of water at least until the water level within the flush tank drops beyond a predetermined activating water level; and, (d) an actuation assembly coupled to said auxiliary assembly, said actuation assembly being operable in at least one mode to displace said activating arm of said auxiliary assembly to said active position thereof.

2. The flush activation system as recited in claim 1 wherein said valve assembly further includes at least one first partial flush float component coupled to said valve member operable to maintain said valve member in said open position during the drainage of water at least until the water level within the flush tank drops beyond a predetermined intermediate water level defined above said predetermined activating water level.

3. The flush activation system as recited in claim 2 wherein said actuation assembly is operable in at least one supplementary mode to displace at least a portion of said flush lever assembly independent of said auxiliary assembly.

4. A flush activation system for controlling the drainage of water from a toilet flush tank during a flush comprising:

(a) a partial flush valve assembly including a valve member and at least one first float component coupled thereto, said valve member being displaceable between open and closed positions for respectively initiating and terminating the drainage of water from the flush tank, said first float component being operable to maintain said valve member in said open position during the drainage of water at least until the water level within the flush tank drops beyond a first predetermined water level;

(b) a displaceable flush lever assembly coupled to said partial flush valve assembly for actuating the displacement of said valve member from said closed position to said open position;

(c) an auxiliary assembly coupled to said flush lever assembly, said auxiliary assembly including an activating arm having at least one second float component coupled adjacent a terminal end thereof, said activating arm being pivotally displaceable between angularly offset active and inactive positions, said activating arm being biased in orientation at said active and inactive positions in angularly opposed directions away from a vertical orientation, said activating arm in said active position actuating at least a portion of said flush lever assembly to maintain said valve member in said open position during the drainage of water at least until the water level within the flush tank drops beyond a second predetermined water level defined below said first predetermined water level; and, (d) an actuation assembly coupled to said flush lever assembly and said auxiliary assembly, said actuation assembly being operable in at least a first mode to displace at least a portion of said flush lever assembly independent of said auxiliary assembly, and in at least a second mode to displace said activating arm of said auxiliary assembly to said active position thereof.

5. The flush activation system as recited in claim 4 wherein said activating arm is biased for displacement to said inactive position thereof responsive to the water level within the flush tank dropping below said second predetermined water level.

6. The flush activation system as recited in claim 5 wherein said activating arm is biased in orientation at least partially by the buoyancy of said second float member at each of said active and inactive positions thereof.

7. The flush activation system as recited in claim 4 wherein said flush lever assembly includes at least one primary lever arm having longitudinally opposed first and second end portions, said primary lever arm being pivotally displaceable about a pivot axis defined at said first end portion, said second end portion being coupled to said partial flush valve assembly.

8. The flush activation system as recited in claim 7 wherein said actuation assembly is operable in both said first and second modes thereof to pivotally displace said primary lever arm for displacing said valve member to said open position, said second float component maintaining said valve member in said open position during the drainage of water at least until the water level drops beyond said second predetermined water level.

9. The flush activation system as recited in claim 7 wherein said flush lever assembly further includes at least one auxiliary lever arm coupled to said auxiliary assembly and having longitudinally opposed first and second end portions, said auxiliary lever arm being pivotally displaceable about a pivot axis defined at said first end portion, said second end portion being coupled to said valve member.

10. The flush activation system as recited in claim 9 wherein said flush lever assembly further includes an adjustable weighting mechanism coupled to said auxiliary lever arm for adjustably counterbalancing said auxiliary assembly.

11. The flush activation system as recited in claim 9 wherein said actuation assembly includes a partial flush portion operable in said first mode to pivotally displace said primary lever arm, and a full flush portion operable in said second mode to pivotally displace said auxiliary lever arm independent of said primary lever arm.

12. The flush activation system as recited in claim 11 wherein said partial and full flush portions of said actuation assembly respectively include partial and full flush handles pivotally displaceable one independent of the other.

13. The flush activation system as recited in claim 11 wherein said flush portions of said actuation assembly including a pivotally displaceable flush handle member, and the other of said flush portions including an axially displaceable flush handle member.

14. The flush activation system as recited in claim 6 wherein said partial flush valve assembly further includes a weighting component adjustably coupled to said valve member for automatically actuating the displacement of said valve member to said closed position responsive to the water level within the flush tank dropping during the drainage of water beyond said first predetermined water level.

15. The flush activation system as recited in claim 14 wherein said weighting component of said partial flush valve assembly includes a body defining an inner compartment, said body having a perforated portion for open access to said inner compartment.

16. The flush activation system as recited in claim 15 wherein said weighting component of said partial flush valve assembly further includes at least one ballast member disposed within said inner compartment for stabilizing the position and orientation of said body.

17. A flush activation system for controlling the drainage of water from a toilet flush tank during a flush comprising:

(a) a partial flush valve assembly including a valve member and at least one first float component coupled thereto, said valve member being displaceable between open and closed positions for respectively initiating and terminating the drainage of water from the flush tank, said first float component being operable to maintain said valve member in said open position during the drainage of water at least until the water level within the flush tank drops beyond a first predetermined water level;

(b) a flush lever assembly coupled to said partial flush valve assembly for actuating the displacement of said valve member from said closed position to said open position, said flush lever assembly including at least one primary lever arm and at least one auxiliary lever arm, each said lever arm having longitudinally opposed first and second end portions and being pivotally displaceable about a pivot axis defined at said first end portion, said second end portion being coupled to said partial flush valve assembly;

(c) an auxiliary assembly coupled to said flush lever assembly, said auxiliary assembly including an activating arm having at least one second float component coupled adjacent a terminal end thereof, said activating arm being pivotally displaceable between angularly offset active and inactive positions, said activating arm being biased in orientation at said active and inactive positions in angularly opposed directions away from a vertical orientation, said activating arm in said active position actuating at least a portion of said flush lever assembly to maintain said valve member in said open position during the drainage of water at least until the water level within the flush tank drops beyond a second predetermined water level defined below said first predetermined water level, said activating arm being biased for displacement to said inactive position responsive to the water level dropping below said second predetermined water level; and, (d) an actuation assembly coupled to said flush lever assembly and said auxiliary assembly, said actuation assembly being operable in at least a first mode to displace at least a portion of said flush lever assembly independent of said auxiliary assembly, and in at least a second mode to displace said activating arm of said auxiliary assembly to said active position thereof.

18. The flush activation system as recited in claim 17 wherein primary lever arm is connected to said first float component, and said auxiliary lever arm is connected to said valve member.

19. The flush activation system as recited in claim 18 wherein said actuation assembly includes a partial flush portion operable in said first mode to pivotally displace said primary lever arm, and a full flush portion operable in said second mode to pivotally displace said auxiliary lever arm independent of said primary lever arm.

20. A flush activation system for controlling the drainage of water from a toilet flush tank during a flush comprising:

(a) a partial flush mechanism independently actuable to initiate and terminate the drainage of a first volume of water from the flush tank, said partial flush mechanism being operable to maintain the drainage of water at least until the water level within the flush tank drops beyond a first predetermined water level;

(b) a full flush mechanism actuable to initiate and terminate the drainage of a second volume water from the flush tank greater than said first volume of water, said flush mechanism including:

(1) a lever arm pivotally displaceable between opening and closing positions for respectively opening and closing a drain seal of the flush tank;

(2) an activating arm coupled to said lever arm, said activating arm being pivotally displaceable between angularly offset active and inactive positions, said activating arm in said active position maintaining said lever arm in said opening position thereof during the drainage of water at least until the water level within the flush tank drops beyond a second predetermined water level defined below said first predetermined water level, said activating arm being biased to displace to said inactive position thereof responsive to the water level dropping below said second predetermined water level; and, (3) at least one float component coupled adjacent a terminal end portion of said activating arm, said float component buoyantly biasing said activating arm in orientation at said active and inactive positions in angularly opposed directions away from a vertical orientation; and, (c) an actuation assembly coupled to said partial and full flush mechanisms for the selective actuation thereof.

21. A flush activation system for controlling the drainage of water from a toilet flush tank during a flush comprising:

(a) a partial flush valve assembly including a valve member and at least one first float component coupled thereto, said valve member being displaceable between open and closed positions for respectively initiating and terminating the drainage of water from the flush tank, said first float component being operable to maintain said valve member in said open position during the drainage of water at least until the water level within the flush tank drops beyond a first predetermined water level;

(b) a displaceable flush lever assembly coupled to said partial flush valve assembly for actuating the displacement of said valve member from said closed position to said open position;

(c) an auxiliary assembly coupled to said flush lever assembly, said auxiliary assembly including:

(1) an activating arm pivotally displaceable between angularly offset active and inactive positions, said activating arm in said active position actuating at least a portion of said flush lever assembly to maintain said valve member in said open position during the drainage of water at least until the water level within the flush tank drops beyond a second predetermined water level defined below said first predetermined water level, said activating arm being biased to displace to said inactive position thereof responsive to the water level dropping below said second predetermined water level; and, (2) at least one second float component coupled adjacent a terminal end portion of said activating arm, said second float component buoyantly biasing said activating arm in orientation at said active and inactive positions in angularly opposed directions away from a vertical orientation; and, (d) an actuation assembly coupled to said flush lever assembly and said auxiliary assembly, said actuation assembly being operable responsive to a first manipulation thereof by a user to displace at least a portion of said flush lever assembly independent of said auxiliary assembly, said actuation mechanism being operable responsive to a second manipulation thereof by a user to both displace at least a portion of said flush lever assembly and displace said activating arm of said auxiliary assembly to said active position thereof.

22. The flush activation system as recited in claim 21 wherein said activating arm is disposed in biased manner for displacement to said inactive position responsive to the water level dropping below said second predetermined water level.

* * * * *